US010947006B2

(12) United States Patent
Yakabe et al.

(10) Patent No.: US 10,947,006 B2
(45) Date of Patent: Mar. 16, 2021

(54) PACKAGING BOX AND PACKAGING METHOD

(71) Applicant: JVC KENWOOD Corporation, Yokohama (JP)

(72) Inventors: Toshiyuki Yakabe, Yokohama (JP); Hideki Samata, Yokohama (JP); Noriyuki Hara, Yokohama (JP); Makiko Katsuyama, Yokohama (JP); Akemi Ichiyanagi, Yokohama (JP); Kazuhiro Kuramoto, Yokohama (JP); Norio Sato, Yokohama (JP); Shinichi Sakano, Yokohama (JP)

(73) Assignee: JVC KENWOOD CORPORATION, Yokohama (JP)

( * ) Notice: Subject to any disclaimer, the term of this patent is extended or adjusted under 35 U.S.C. 154(b) by 0 days.

(21) Appl. No.: 16/197,872

(22) Filed: Nov. 21, 2018

(65) Prior Publication Data

US 2019/0185199 A1 Jun. 20, 2019

(30) Foreign Application Priority Data

Dec. 20, 2017 (JP) ..... JP2017-243444

(51) Int. Cl.

| | |
|---|---|
| ***B65D 5/50*** | (2006.01) |
| ***B65D 5/48*** | (2006.01) |
| ***B65B 5/04*** | (2006.01) |
| ***B65D 5/02*** | (2006.01) |
| ***B65D 5/66*** | (2006.01) |

(52) U.S. Cl.

CPC ..... *B65D 5/5002* (2013.01); *B65B 5/04* (2013.01); *B65D 5/0254* (2013.01); *B65D 5/48016* (2013.01); *B65D 5/5004* (2013.01); *B65D 5/6602* (2013.01)

(58) Field of Classification Search

CPC . B65D 5/5002–5/5009; B65D 5/48016; B65D 5/446; B65D 5/5095; B65D 5/445; B65D 5/50; B65D 5/5213; B65D 85/65

USPC ..... 229/120.21, 120.13, 120.04, 120.05, 229/120.17, 120.32, 120.37, 122.32, 919; 206/751, 756, 476, 477, 482, 483, 495, 206/593, 784

See application file for complete search history.

(56) References Cited

U.S. PATENT DOCUMENTS

| | | | | |
|---|---|---|---|---|
| 2,005,967 A * | 6/1935 | Berdan | ..... | B65D 75/38 206/454 |
| 2,144,071 A * | 1/1939 | Loth | ..... | B65D 81/03 206/455 |
| 7,607,565 B2 * | 10/2009 | Noguchi | ..... | B65D 5/6608 206/232 |

FOREIGN PATENT DOCUMENTS

JP 2002274527 A 9/2002

* cited by examiner

*Primary Examiner* — Christopher R Demeree
*Assistant Examiner* — Phillip D Schmidt
(74) *Attorney, Agent, or Firm* — Nath, Goldberg & Meyer; Jerald L. Meyer; Stanley N. Protigal

(57) ABSTRACT

A packaging box includes a shelf portion which partitions an interior of the packaging box into an upper space and a lower space, an inner flap which is located above the shelf portion as an inner lid and which is bendable to a closed position where the inner flap faces the shelf portion while extending parallel thereto, and a hold-down piece which is disposed at a position facing the inner flap at the closed position in the shelf portion and which has a first bent portion bendable to protrude outward in a middle portion of the hold-down piece, the hold-down piece formed by cutting and raising the shelf portion to be capable of standing in a tilted state where a distal end side thereof extends toward a first side portion.

8 Claims, 8 Drawing Sheets

PACKAGING BOX AND PACKAGING METHOD

CROSS REFERENCE TO RELATED APPLICATION

This application is based upon and claims the benefit of priority from the prior Japanese Patent Application No. 2017-243444 (filing date: Dec. 20, 2017), the entire contents of which are incorporated herein by reference.

TECHNICAL FIELD

The present invention relates to a packaging box and a packaging method.

RELATED ART

There is known a packaging box having a structure in which accessories can be packaged together with a product (see Japanese Patent Application Publication No. 2002-274527). In the packaging box described in Japanese Patent Application Publication No. 2002-274527, slit portions are formed in a set of inner flaps which are provided in the box and which open like double doors to tuck and fix a user manual being an accessory.

SUMMARY

Although the structure of the slit portions in the packaging box described in Japanese Patent Application Publication No. 2002-274527 allows a thin user manual to be tucked, the tucking is difficult when the user manual is thick. Moreover, user manuals vary in thickness or the number of documents to be packaged, depending on the specifications of products and countries to which to deliver the products, so that user manuals generally vary in entire thickness (height). The box described in Japanese Patent Application Publication No. 2002-274527 cannot hold the user manuals varying in thickness as described above and there is room for improvement.

The same applies to the case where the accessory is not a booklet but a flat separate packaging box.

An object of the present invention is to provide a packaging box and a packaging method which can preferably hold an accessory regardless of its thickness.

A packaging box according to the first aspect of the present invention includes a shelf portion which partitions an interior of the packaging box into an upper space and a lower space, an inner flap which is located above the shelf portion as an inner lid and which is bendable to a closed position where the inner flap faces the shelf portion while extending parallel thereto, and a hold-down piece which is disposed at a position facing the inner flap at the closed position in the shelf portion and which has a first bent portion bendable to protrude outward in a middle portion of the hold-down piece, the hold-down piece formed by cutting and raising the shelf portion to be capable of standing in a tilted state where a distal end side thereof extends toward a first side portion.

A packaging method according to the second aspect of the present invention uses the packaging box according to the first aspect. The packaging method includes causing the hold-down piece to stand in the tilted state where a distal end portion of the hold-down piece is located above a lower surface of the inner flap at the closed position while bending the first bent portion to make it protrude outward. An object to be packaged is placed on the shelf portion such that the object to be packaged comes into contact or is capable of coming into contact with a tilted portion of the hold-down piece on a base side of the first bent portion, and the inner flap is brought to the closed position and caused to bias the hold-down piece downward so as to cause the packaging box to hold the object to be packaged between the tilted portion and each of the shelf portion and the first side portion.

A packaging method according to the third aspect of the present invention uses a packaging box comprising a shelf portion which partitions an interior of the packaging box into an upper space and a lower space, an inner flap which is located above the shelf portion as an inner lid and which is bendable to a closed position where the inner flap faces the shelf portion while extending parallel thereto, and a hold-down piece which is disposed at a position facing the inner flap at the closed position in the shelf portion and which the hold-down piece formed by cutting and raising the shelf portion to be capable of standing in a tilted state where a distal end side thereof extends toward a first side portion. The hold-down piece is caused to stand in the tilted state where a distal end portion of the hold-down piece is located above a lower surface of the inner flap at the closed position. An object to be packaged on the shelf portion is placed such that the object to be packaged comes into contact or is capable of coming into contact with a tilted portion on a base side of the hold-down piece, and bringing the inner flap to the closed position and causing the inner flap to bias the hold-down piece downward to cause the packaging box to hold the object to be packaged between the tilted portion and each of the shelf portion and the first side portion.

A packaging box and a packaging method according to the aspects of the present invention can preferably hold an accessory regardless of its thickness.

DETAILED DESCRIPTION

Figure 1:
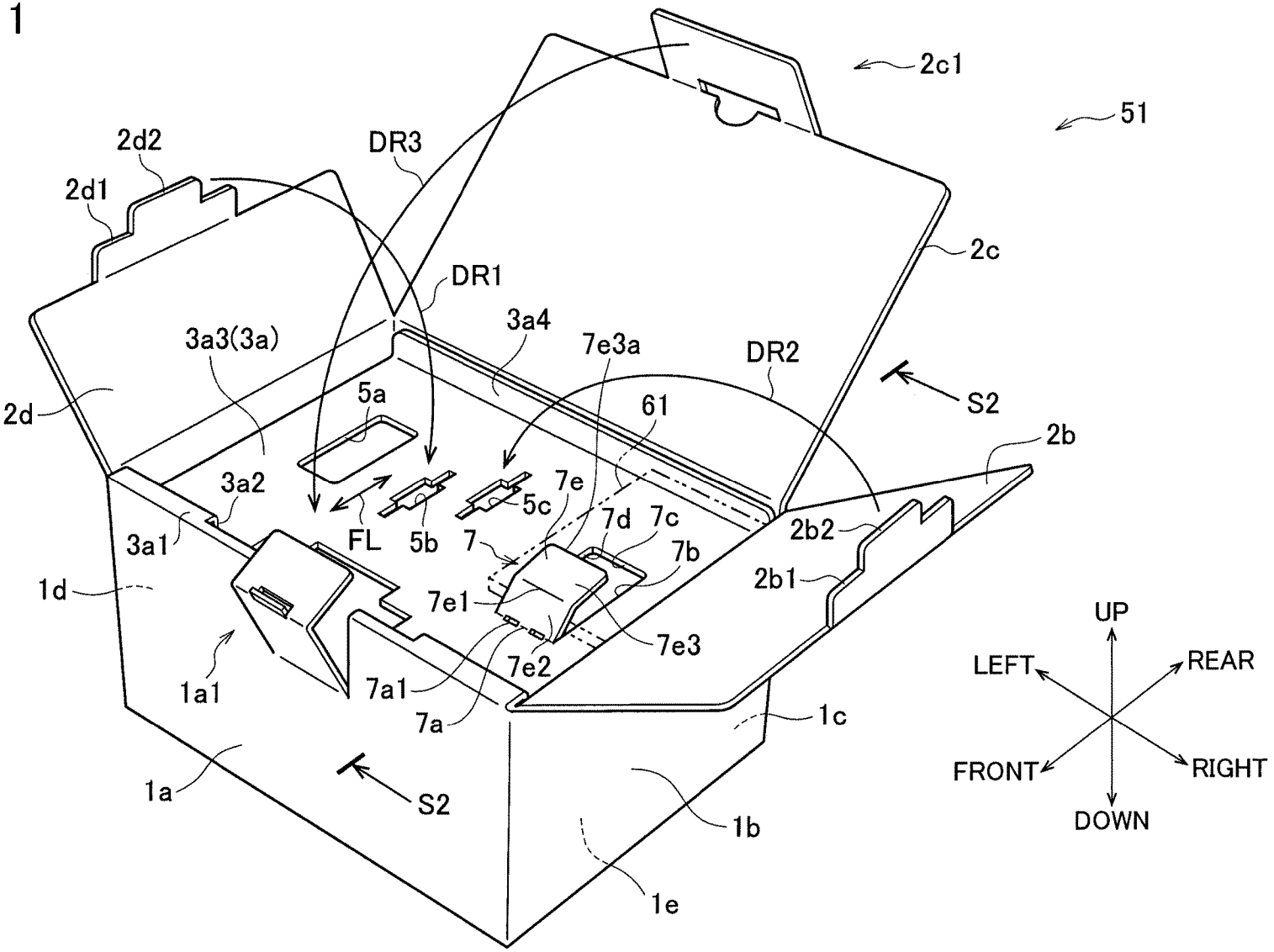
FIG. 1 is a perspective view of a box 51 which is Example 1 of a packaging box according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

A packaging box according to an embodiment of the present invention is described by using a box 51 of Example 1 and a box 51B of Example 2.

Example 1

FIG. 1 is a perspective view illustrating the box 51 of Example 1 in an open state before being sealed. The directions of left, right, up, down, front and rear are defined as illustrated by the arrows in FIG. 1 for the sake of explanation. The box 51 is a so-called bottom assembly type corrugated box with a tuck in flap and the material property thereof is, for example, E flute.

As illustrated in FIG. 1, the box 51 includes four side portions of a front face portion 1*a*, a right face portion 1*b*, a rear face portion 1*c*, and a left face portion 1*d* and, for example, is assembled into a frame shape by being glued at a glue tab at a corner portion connecting the left face portion 1*d* and the front face portion 1*a*. A bottom portion 1*e* is formed by combining four bottom flaps formed to be connected to lower portions of the respective side surfaces. A right inner flap 2*b* and a left inner flap 2*d* are formed to be connected respectively to upper portions of the right face portion 1*b* and the left face portion 1*d*. A lid 2*c* which is an outer flap is formed to be connected to an upper portion of the rear face portion 1*c*.

Figure 2:
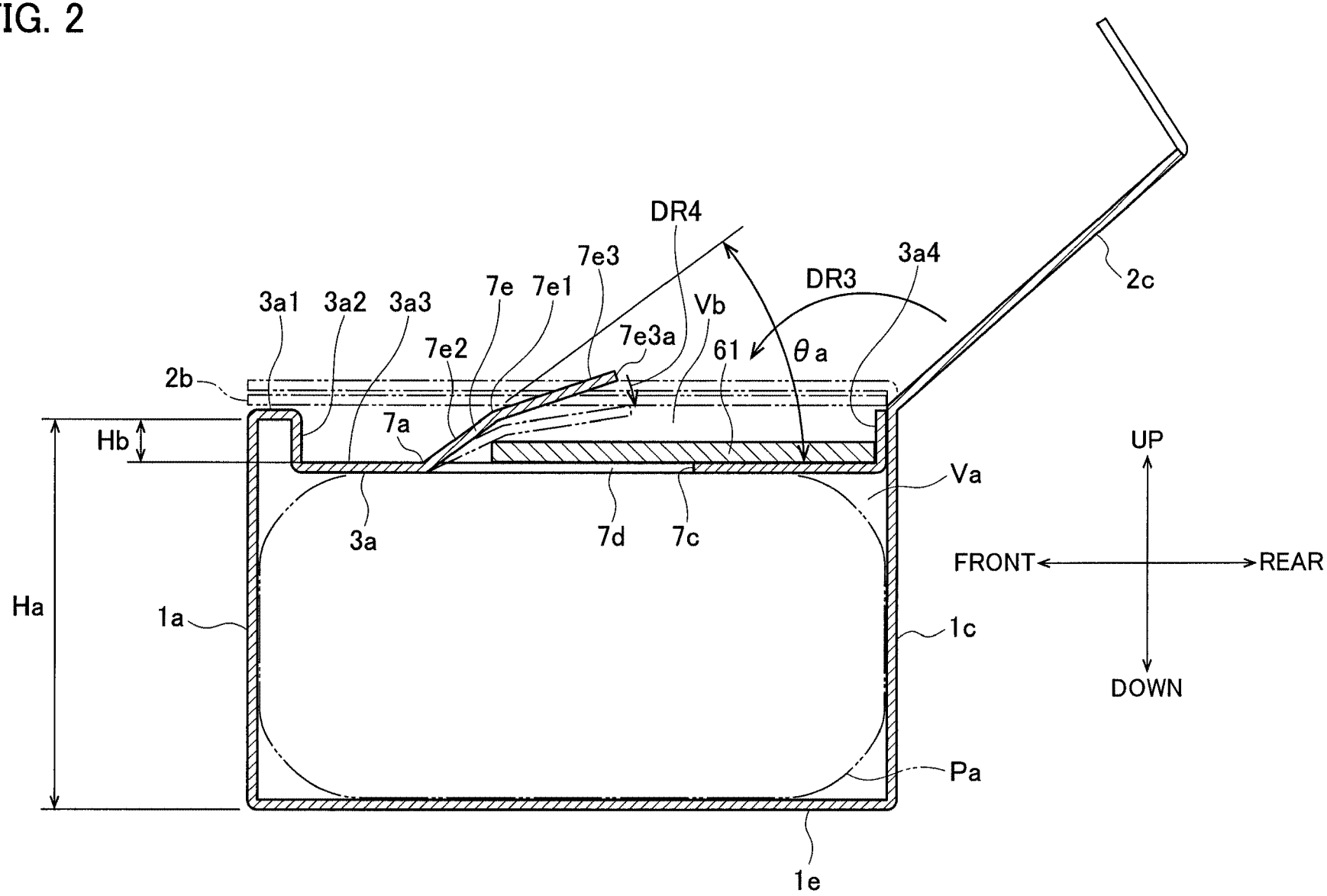
FIG. 2 is a cross-sectional view at the position S2-S2 in FIG. 1.

A shelf wall portion 3*a* partitioning the inside of the box 51 into upper and lower portions is formed to be connected to an upper portion of the front face portion 1*a*. In the shelf wall portion 3*a*, the direction of the arrow FL is the flute direction. FIG. 2 is a cross-sectional view at a position S2-S2 in FIG. 1 and FIGS. 1 and 2 illustrate a used state where the shelf wall portion 3*a* is bent in a predetermined procedure.

In the used state, the shelf wall portion 3*a* includes a reference plane portion 3*a*1 which extends rearward from the front face portion 1*a* side at a position where the height from a lower surface of the bottom portion 1*e* is a reference height Ha, a step portion 3*a*2 which is connected to a rear portion of the reference plane portion 3*a*1 and extends downward to a predetermined depth, a shelf portion 3*a*3 which horizontally extends rearward from a lower end of the step portion 3*a*2, and an abutting portion 3*a*4 which extends upward from a rear end of the shelf portion 3*a*3. The dimensions of the shelf wall portion 3*a* are set such that the abutting portion 3*a*4 slightly pushes an inner surface of the rear face portion 1*c* rearward.

A space inside the box 51 is divided into upper and lower portions by the shelf portion 3*a*3. A packaging material Pa in which a product is packaged is housed in a lower space Va being a space on the lower portion. The product is for example, a video camera. The position of the shelf wall portion 3*a* in an up-down direction is determined by bringing the shelf wall portion 3*a* into contact with an upper portion of the packaging material Pa. Specifically, the height position of an upper surface of the shelf portion 3*a*3 in the shelf wall portion 3*a* is determined to be a position below the reference height Ha by a height Hb. An accessory 61 which is a packaged object is housed in an upper space Vb which is a space in the upper portion. The accessory 61 is, for example, a booklet such as a user manual, a connection cable, a power adaptor, or the like.

As illustrated in FIG. 1, an inspection hole 5*a*, a left engagement slit 5*b*, a right engagement slit 5*c*, and a hold-down piece portion 7 are formed in the shelf portion 3*a*3 in this order from the left side. The inspection hole 5*a* is an opening used to visually check whether the packaging material Pa is housed in the lower space Va in the used state of the shelf wall portion 3*a*. The left engagement slit 5*b* engages (arrow DR1) with an engagement protruding piece 2*d*2 which is part of an engagement piece 2*d*1 when the left inner flap 2*d* is bent, the engagement piece 2*d*1 protruding from a front end of the left inner flap 2*d*. By this engagement, the engagement piece 2*d*1 becomes a supporting wall standing in the up-down direction and maintains the left inner flap 2*d* in a horizontal position. Similarly, the right engagement slit 5*c* engages (arrow DR2) with an engagement protruding piece 2*b*2 which is part of an engagement piece 2*b*1 when the right inner flap 2*b* is bent, the engagement piece 2*b*1 protruding from a front end of the right inner flap 2*b*. By this engagement, the engagement piece 2*b*1 becomes a supporting wall standing in the up-down direction and maintains the right inner flap 2*b* in a horizontal position.

The left inner flap 2*d* and the right inner flap 2*b* are bent to be set to the horizontal positions and then the lid 2*c* is bent (arrow DR3) to cause an engagement portion 2*c*1 to engage with a lid engagement portion 1*a*1 formed in an upper portion of the front face portion 1*a*. By this engagement, the lid 2*c* is maintained in a closed state. As an engagement structure between the engagement portion 2*c*1 and the lid engagement portion 1*a*1, it is possible to use a well-known structure in a general corrugated box such as a type with a tuck in flap.

In FIG. 2, the state where the right inner flap 2*b* and the lid 2*c* are closed is illustrated by chain lines. Specifically, the right inner flap 2*b* is in contact with the upper surface of the reference plane portion 3*a*1 of the shelf wall portion 3*a* to be in the horizontal position and the lid 2*c* is laid over the right inner flap 2*b* to be in the horizontal state.

The hold-down piece portion 7 includes left, right, and rear cuts 7*d*, 7*c*, 7*b* which are formed in the shelf portion 3*a*3 in a square U-shape and a hold-down piece 7*e* which is separated from the shelf portion 3*a*3 at the cuts 7*d*, 7*c*, 7*b* and which has a front portion connected to the shelf portion 3*a*3 as a connection portion 7*a*. The cuts 7*d* and 7*b* extend in the front-rear direction and the cut 7*c* extends in the left-right direction. Specifically, a portion of the hold-down piece 7*e* beyond the connection portion 7*a* can be made to stand relative to the shelf portion 3*a*3. FIGS. 1 and 2 illustrate a state where the hold-down piece 7*e* is raised by the finger or the like before being used.

Slits 7*a*1 are partially formed in the connection portion 7*a*. This can facilitate bending of the connection portion 7*a* by the finger or the like and cause the hold-down piece 7*e* to stand in a tilted state. Moreover, forming the slits 7*a*1 can reduce the stiffness of the connection portion 7*a* to such a level that, although the hold-down piece 7*e* can keep standing at a certain tilt angle by itself after being bent to stand in the tilted state, the tilt angle of the hold-down piece 7*e* can be easily changed by applying external force.

A bent portion 7*e*1 which has low bend stiffness and can be easily bent is formed in a center portion of the hold-down piece 7*e* in the front-rear direction by being pressed down halfway or the like. When the hold-down piece 7*e* is to be made to stand in the tilted state, the hold-down piece 7*e* is preferably slightly bent to protrude outward at the bent portion 7*e*1.

A portion of the hold-down piece 7*e* from the connection portion 7*a* to the bent portion 7*e*1 is referred to as a base portion 7*e*2 and a portion from the bent portion 7*e*1 to a distal end is referred to as a distal end portion 7*e*3. The hold-down piece 7*e* is made to stand in the tilted state in advance before being used, that is before the accessory is housed with the right inner flap 2*b* being open. An angle θa which is the tilt angle is set to be smaller than 90°. In this tilted standing position, the bent portion 7*e*1 protrudes outward, that is protrudes upward, the distal end portion 7*e*3 is tilted to extend upward toward the distal end, and the height position of the distal end 7*e*3*a* is above the reference height Ha. Moreover, the hold-down piece 7*e* stands with the distal end side thereof tilted toward the rear face portion 1*c* of the box 51.

The hold-down piece portion 7 is provided to house the accessory (for example, booklet 61) between the hold-down piece 7*e* and the abutting portion 3*a*4 of the shelf wall portion 3*a*. Specifically, the hold-down piece portion 7 is formed to hold the booklet 61 between the base portion 7*e*2 of the hold-down piece 7*e* and the abutting portion 3*a*4 in the front-rear direction and hold the booklet 61 between the base portion 7*e*2 of the hold-down piece 7*e* and the shelf portion 3*a*3 in the up-down direction.

When the booklet 61 is to be housed, as illustrated in FIGS. 1 and 2, the booklet 61 is placed on the shelf portion 3*a*3 while causing a rear end of the booklet 61 to abut on the abutting portion 3*a*4 and inserting a front end of the booklet 61 inside the hold-down piece 7*e*. Next, the right inner flap 2*b* is bent to cause the engagement protruding piece 2*b*2 to engage with the right engagement slit 5*c*. The right inner flap 2*b* is thereby set to the horizontal position. Then, the lid 2*c* is bent to cause the engagement portion 2*c*1 to engage with the lid engagement portion 1*a*1 and is thus closed in the horizontal position.

Figure 3:
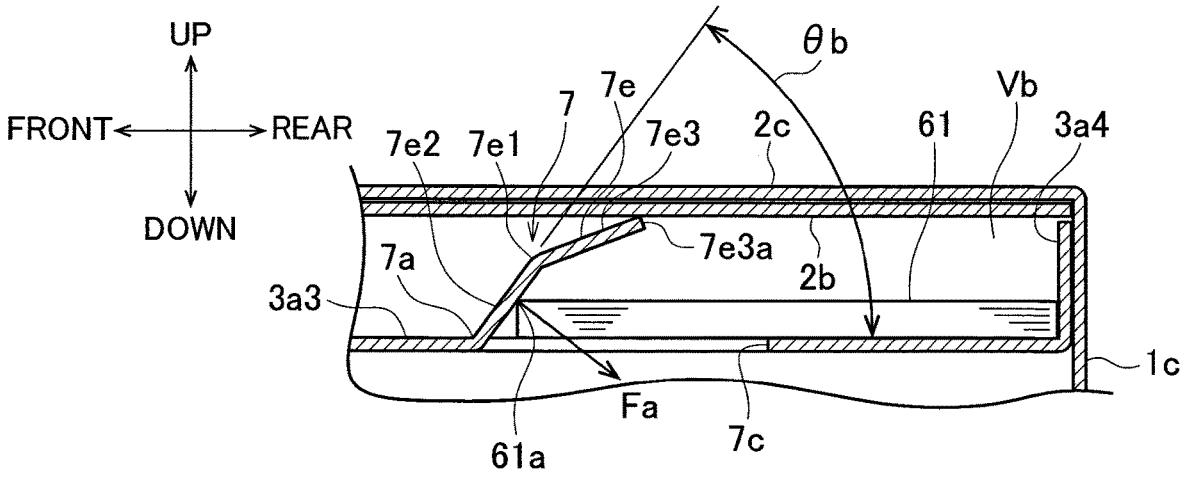
FIG. 3 is a partial cross-sectional view illustrating a first holding mode of an accessory in the box 51.

In this case, since at least the distal end 7*e*3*a* of the distal end portion 7*e*3 in the hold-down piece 7*e* is above the reference height Ha, the hold-down piece 7*e* is pressed downward by the right inner flap 2*b* and is tilted (arrow DR4) toward the shelf portion 3*a*3. FIG. 3 is a partial cross-sectional view illustrating a state where the hold-down piece 7*e* is pressed down by the right inner flap 2*b* as described above. As illustrated in FIG. 3, the base portion 7*e*2 comes into contact with an upper front corner portion 61*a* of the booklet 61 and biases the booklet 61 toward the oblique lower rear side with force Fa. Specifically, the booklet 61 biases the abutting portion 3*a*4 rearward with component force of the force Fa in the front-rear direction and biases the shelf portion 3*a*3 downward with component force of the force Fa in the up-down direction.

The booklet 61 is thereby held between the hold-down piece 7*e* and the abutting portion 3*a*4 on the shelf portion 3*a*3.

Figure 4:
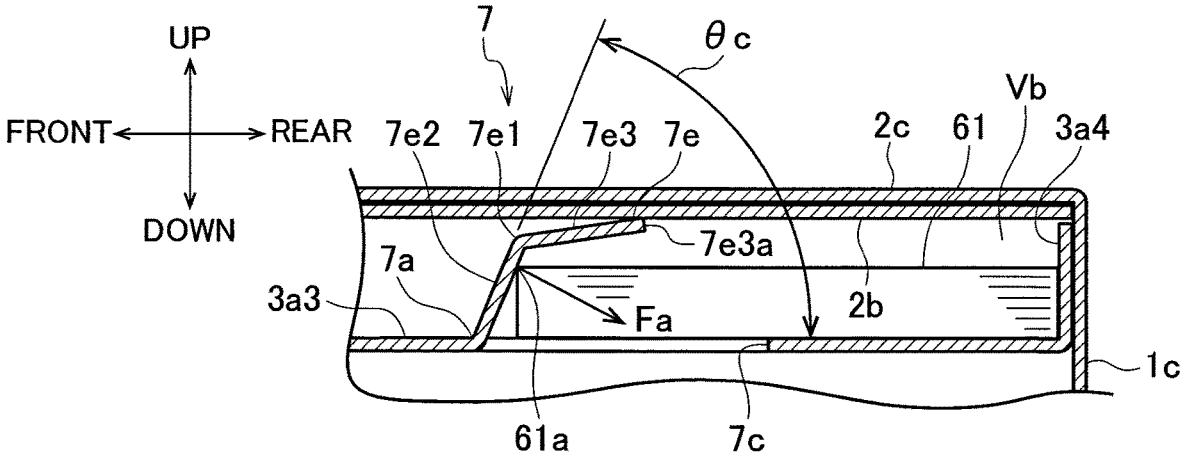
FIG. 4 is a partial cross-sectional view illustrating a second holding mode of the accessory in the box 51.

Any booklet 61 is similarly held regardless of its thickness as long as the upper front corner portion 61*a* comes into contact with the base portion 7*e*2 of the hold-down piece 7*e* as described above. FIG. 4 illustrates a holding mode in the case where the thickness of the booklet 61 is greater than that described in FIG. 3. When the thickness of the booklet 61 is greater, the tilt angle θc of the base portion 7*e*2 is greater than the tilt angle θb in FIG. 3 but the booklet 61 is preferably held.

Figure 5:
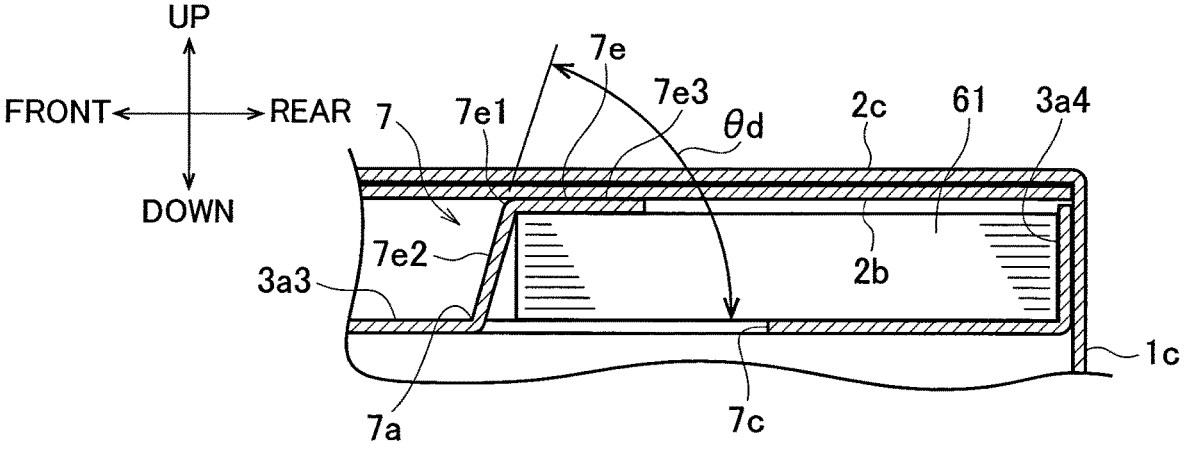
FIG. 5 is a partial cross-sectional view illustrating a third holding mode of the accessory in the box 51.

FIG. 5 is a partial cross-sectional view illustrating a holding mode in a case where the thickness of the booklet 61 is the maximum thickness holdable by the box 51. In this case, the distal end portion 7*e*3 of the hold-down piece 7*e* comes into tight contact with the booklet 61 and is held between the booklet 61 and the right inner flap 2*b*. Moreover, in this state, the tilt angle θd of the base portion 7*e*2 is greater than the tilt angle θc described in FIG. 4 and is closer to 90°.

It is apparent from the aforementioned structure that the accessory is not limited to the booklet 61. In the box 51, the hold-down piece portion 7 can hold any accessory in the upper space Vb as long as the accessory has a substantially-box shape.

As described above in detail, in the box 51 of Example 1, closing the right inner flap 2*b* presses the hold-down piece 7*e* downward and the tilted base portion 7*e*2 of the hold-down piece 7*e* biases the upper front corner portion 61*a* of the accessory (for example, booklet 61) obliquely downward. Accordingly, the box 51 can hold the booklet 61 by holding it between the hold-down piece 7*e* and the abutting portion 3*a*4 and between the hold-down piece 7*e* and the shelf portion 3*a*3. The box 51 can thereby preferably hold the booklet 61 between the hold-down piece portion 7 and each of the shelf portion 3*a*3 and the abutting portion 3*a*4 regardless of the thickness of the booklet 61 as long as the upper front corner portion 61*a* comes into contact with the base portion 7*e*2.

Example 2

Figure 6:
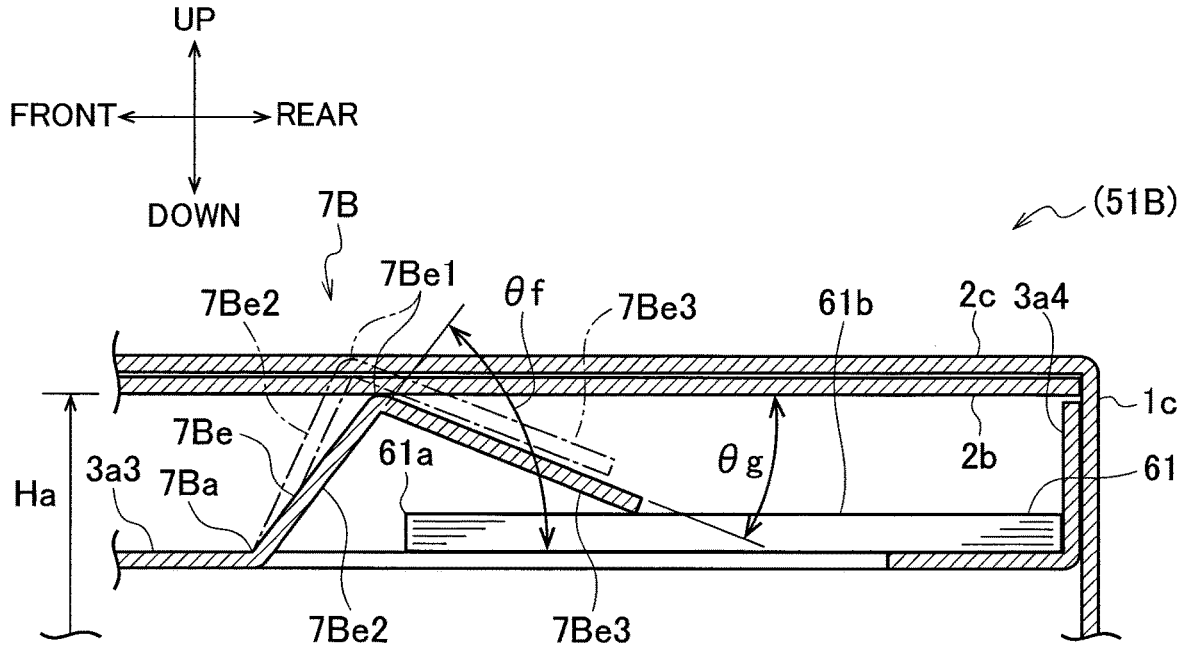
FIG. 6 is a partial cross-sectional view illustrating a first holding state of the accessory in a box 51B which is Example 2 of a packaging box according to an embodiment of the present invention.

Example 2 is a box 51B in which the hold-down piece portion 7 of the box 51 is replaced by a hold-down piece portion 7B. Specifically, the box 51B is different from the box 51 only in a hold-down piece 7Be of the hold-down piece portion 7B. FIG. 6 is a partial cross-sectional view illustrating a state where the hold-down piece portion 7B of the box 51B is holding the booklet 61 being the accessory and is a view corresponding to FIG. 3.

Before being used, as illustrated by chain lines of FIG. 6, the hold-down piece 7Be is made to stand in a tilted state in which a bent portion 7Be1 is located above the reference height Ha. When the right inner flap 2*b* and the lid 2*c* are closed in this state, the right inner flap 2*b* presses the bent portion 7Be1 downward. A distal end portion 7Be3 thereby presses down an upper surface 61*b* of the booklet 61 from above and the booklet 61 is thus held.

Figure 7:
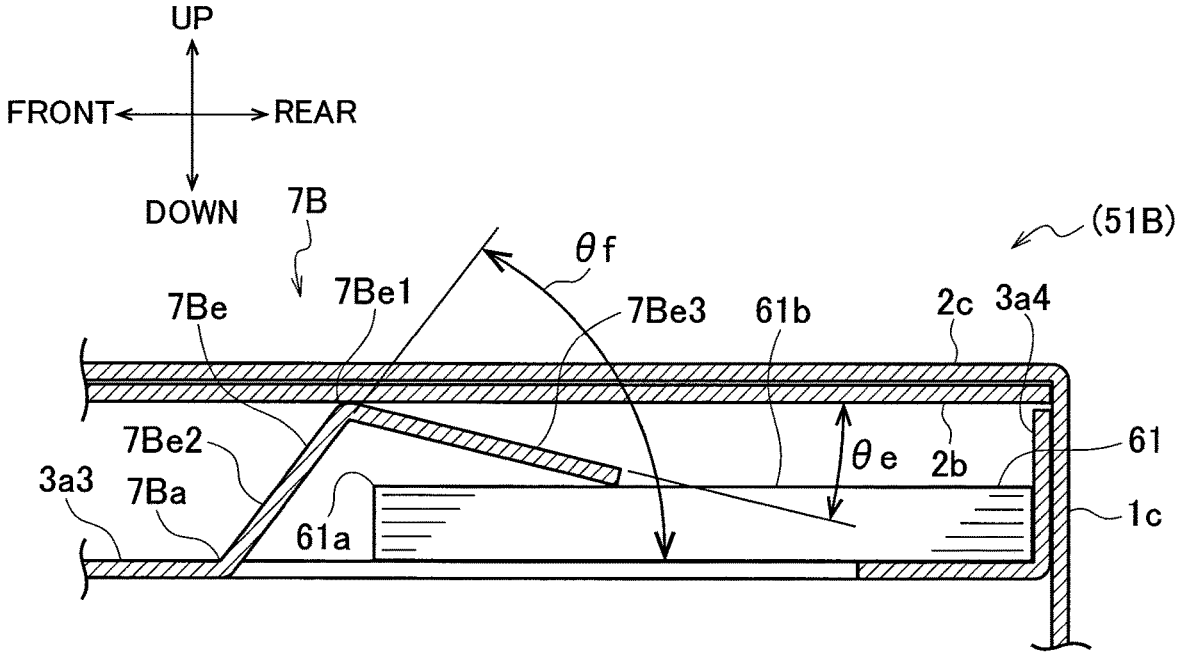
FIG. 7 is a partial cross-sectional view illustrating a second holding mode of the accessory in the box 51B.

FIG. 7 is a partial cross-sectional view illustrating a holding mode in the case where the thickness of the booklet 61 is greater than that described in FIG. 6. When the thickness of the booklet 61 is greater, the tilt angle θe of the distal end portion 7Be3 relative to the horizontal direction is smaller than the tilt angle θg in FIG. 6. However, the upper surface 61*b* of the booklet 61 is pressed down by the distal end portion 7Be3 and the booklet 61 is preferably held.

Figure 8:
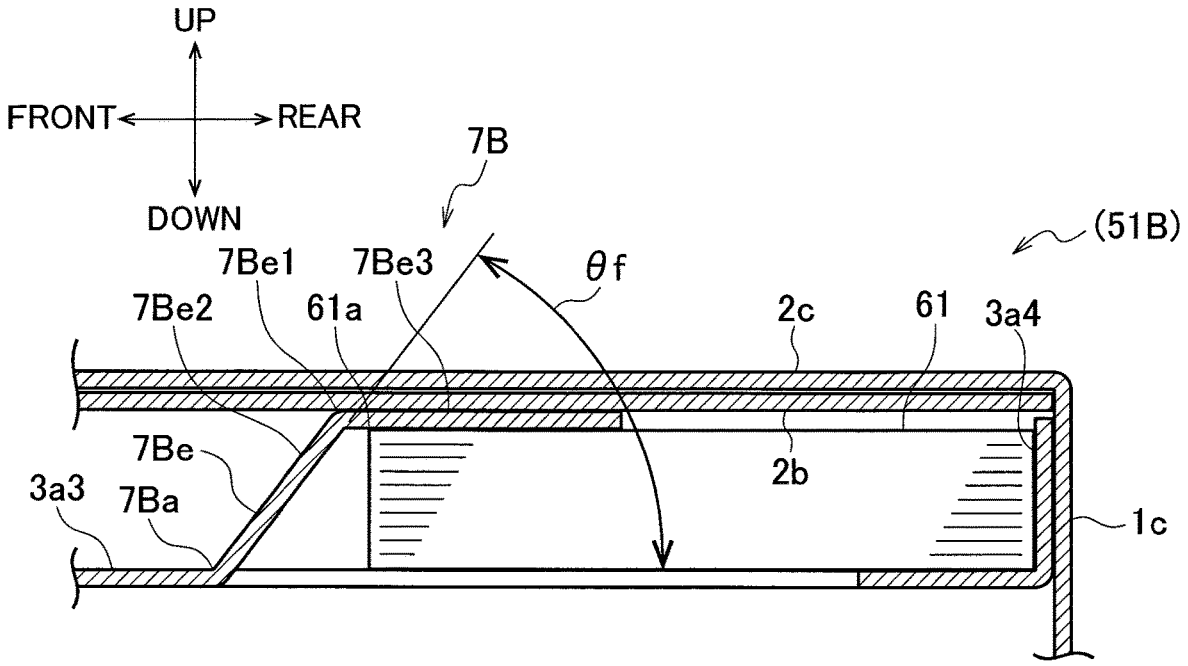
FIG. 8 is a partial cross-sectional view illustrating a third holding mode of the accessory in the box 51B.

FIG. 8 is a partial cross-sectional view illustrating a holding mode in a case where the thickness of the booklet 61 is the maximum thickness holdable by the box 51B. In this case, as in the box 51, the distal end portion 7Be3 of the hold-down piece 7Be comes into tight contact with the booklet 61 and is held between the booklet 61 and the right inner flap 2*b*. Moreover, as illustrated in FIGS. 6 to 8, the tilt angle θf of a base portion 7Be2 is constant regardless of the thickness of the booklet 61.

Figure 9:
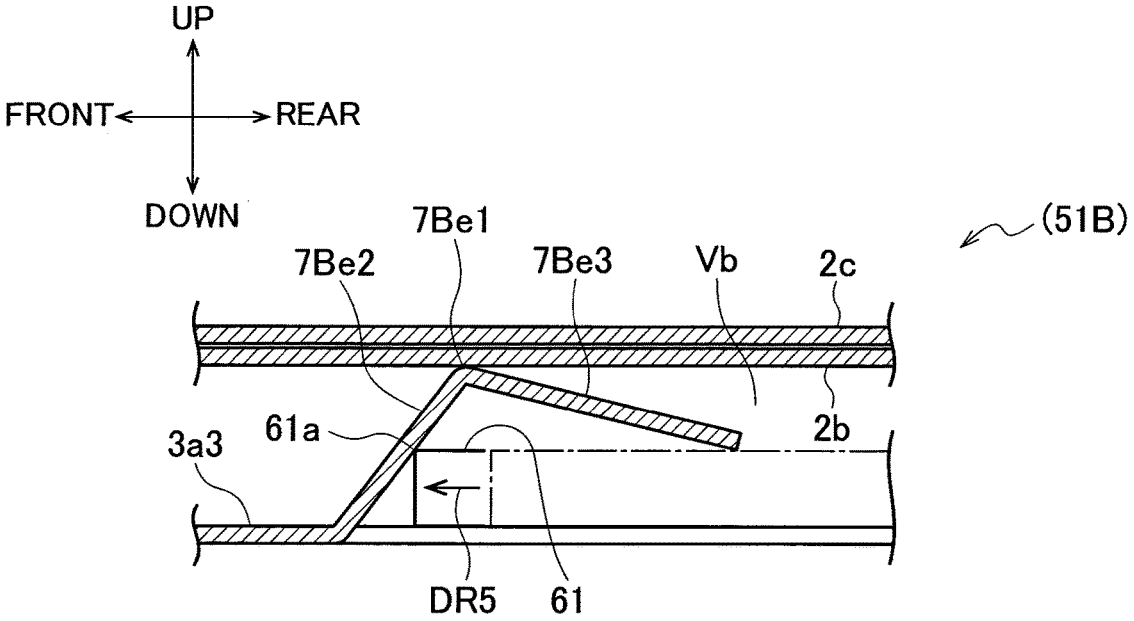
FIG. 9 is a partial cross-sectional view for explaining a holding mode of the accessory in the box 51B.

In box 51B, the upper front corner portion 61*a* of the booklet 61 does not necessarily come into contact with the base portion 7Be2. Accordingly, various booklets 61 can be held even when the booklets 61 vary in the length in the front-rear direction, although the booklets 61 may slightly move in the front-rear direction. Moreover, for example, when the box 51B is tilted downward toward the front side, as illustrated in FIG. 9, there may be a case where the booklet 61 moves forward and the upper front corner portion 61*a* biases (arrow DR5) the base portion 7Be2 forward. Also in this case, the bent portion 7Be1 is firmly held down by the right inner flap 2*b* and the movement of the base portion 7Be2 is restricted. Thus, the movement of the booklet 61 is also restricted and the booklet 61 is firmly held while being allowed to slightly move in the front-rear direction in the upper space Vb.

It is apparent from the aforementioned structure that the accessory is not limited to the booklet 61. In the box 51B, an accessory of any shape can be held in the upper space Vb as long as the distal end portion 7Be3 of the hold-down piece portion 7B can press the accessory downward.

As described above in detail, in the box 51B of Example 2, closing the right inner flap 2*b* presses downward the bent portion 7Be1 protruding upward and the distal end portion 7Be3 presses downward the upper surface 61*b* of the accessory 61. Accordingly, the box 51B can hold the booklet 61 by holding it between the hold-down piece 7Be and the shelf portion 3*a*3.

The examples described above in detail are not limited to the aforementioned configurations and may be modified examples modified within a scope not departing from the spirit of the present invention.

The hold-down piece 7*e*, 7Be in Examples 1, 2 may be modified to hold-down pieces 71*e*, 71Be which include supporting pieces 71*f*, 71Bf as bent portions protruding further from the distal ends 7*e*3*a*, 7Be3*a* of the hold-down pieces 71*e*, 71Be. These hold-down pieces 71*e*, 71Be are described with reference to FIGS. 10 to 13.

Figure 10:
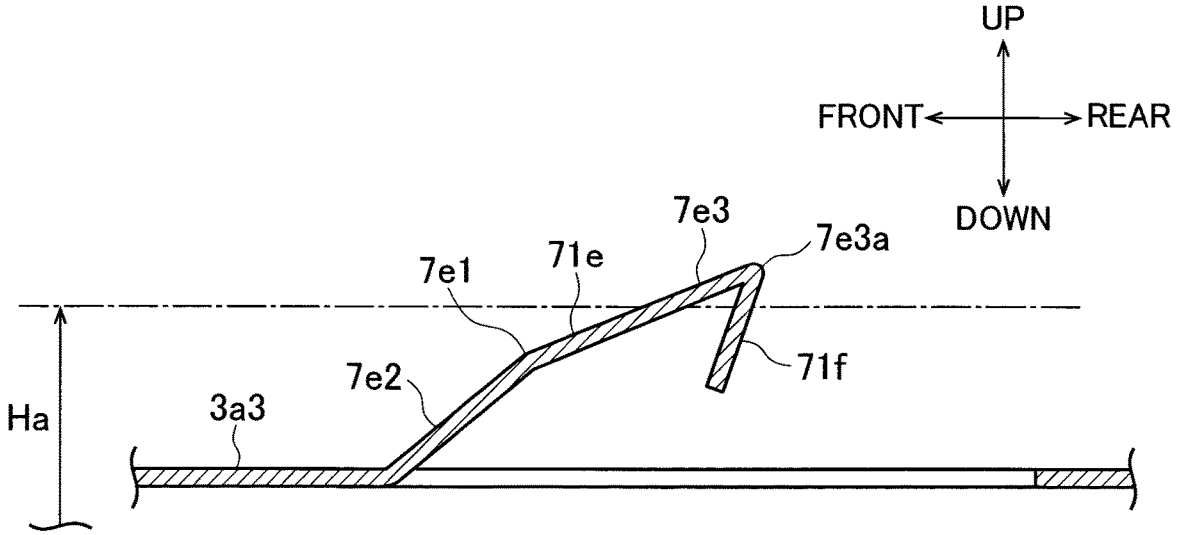
FIG. 10 is a partial cross-sectional view illustrating a modified example of the box 51.
Figure 11:
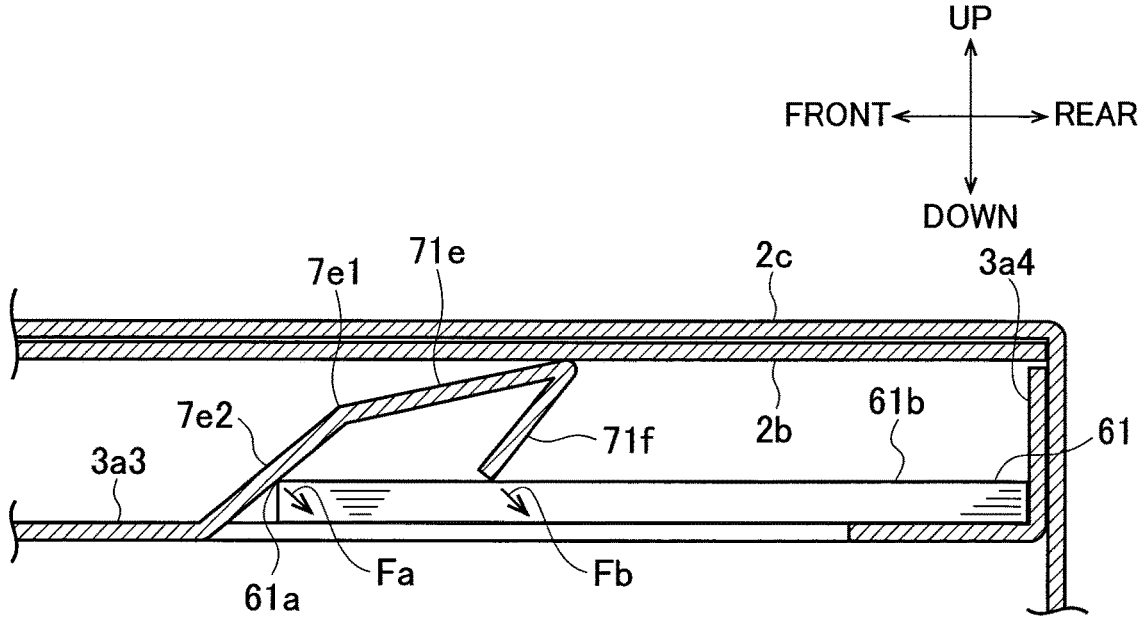
FIG. 11 is a partial cross-sectional view illustrating a holding mode of the accessories in the modified example of the box 51.

FIG. 10 is a partial cross-sectional view illustrating the hold-down piece 71*e* which is the modified example of the hold-down piece 7*e* in Example 1. Before being used, the hold-down piece 71*e* is set to a state where a portion thereof including the distal end 7*e*3*a* is located above the reference height position Ha and the distal end of the supporting piece 71*f* is bent to extend downward toward the front side. FIG. 11 is a partial cross-sectional view illustrating a state where the hold-down piece 71*e* holds the booklet 61. As illustrated in FIG. 11, the booklet 61 receives not only the force Fa from the base portion 7*e*2 at the upper front corner portion 61*a* but also force Fb from the supporting piece 71*f* on the upper surface 61*b*, the force Fb generated by resilience of the bent supporting piece 71*f*. Accordingly, the booklet 61 is more surely held.

Figure 12:
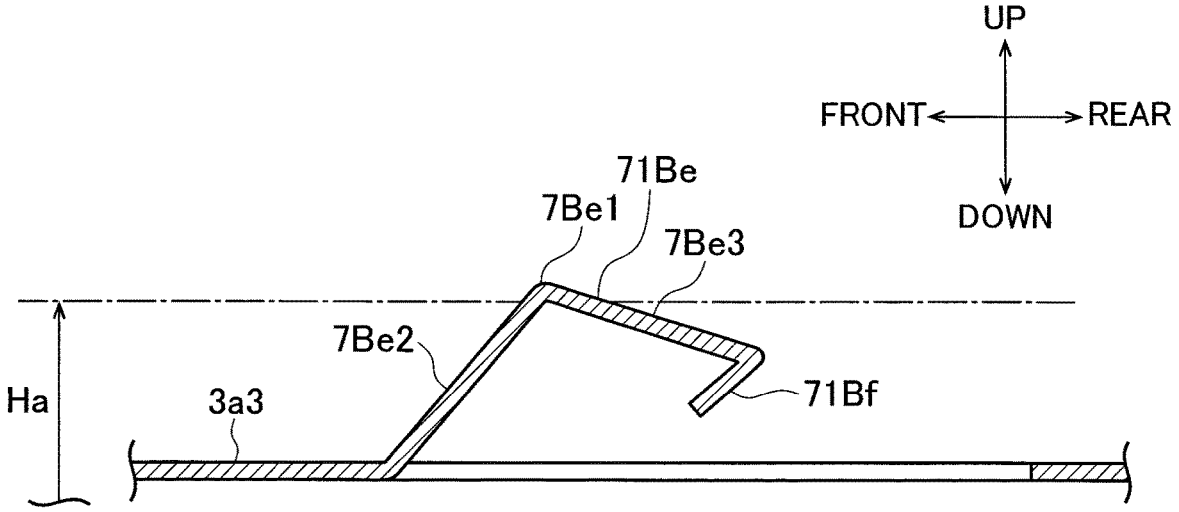
FIG. 12 is a partial cross-sectional view illustrating a modified example of the box 51B.
Figure 13:
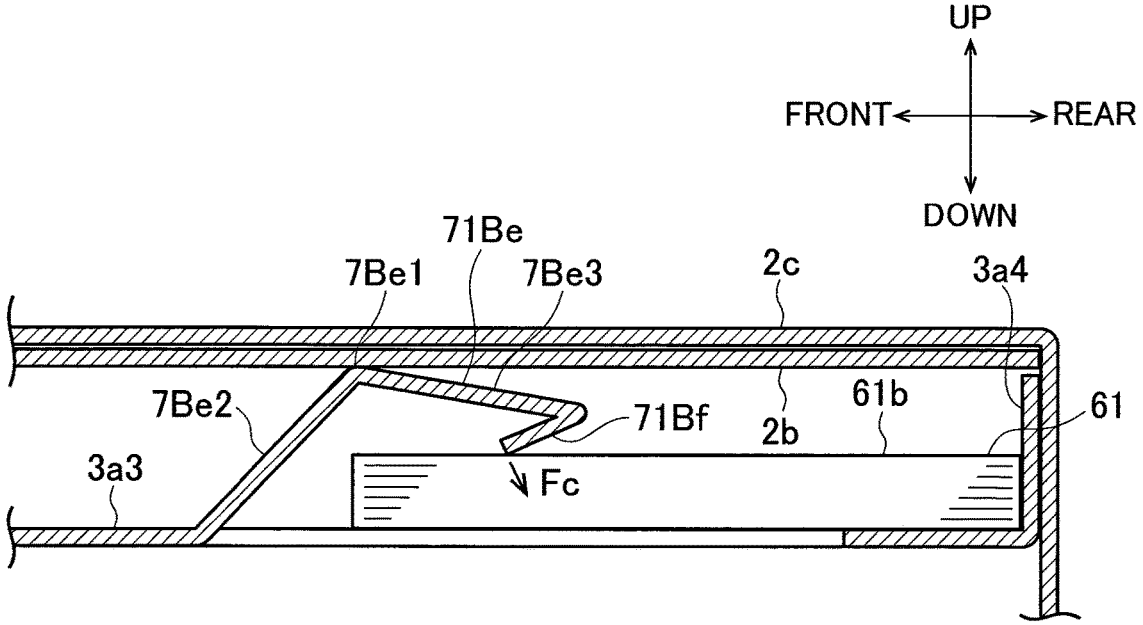
FIG. 13 is a partial cross-sectional view illustrating a holding mode of the accessories in the modified example of the box 51B.

FIG. 12 is a partial cross-sectional view illustrating the hold-down piece 71Be which is the modified example of the hold-down piece 7Be in Example 2. Before being used, the hold-down piece 71Be is set to a state where a portion thereof including the bent portion 7Be1 is located above the reference height position Ha and the distal end of the supporting piece 71Bf is bent to extend downward toward the front side. FIG. 13 is a partial cross-sectional view illustrating a state where the hold-down piece 71Be holds the booklet 61. As illustrated in FIG. 13, the booklet 61 receives force Fc from the supporting piece 71Bf, the force Fc being resultant force of the resilience of the bent supporting piece 71Bf and force originally generated when the bent portion 7Be1 is held down by the right inner flap 2*b*. Accordingly, the booklet 61 is more surely held.

Figure 14:
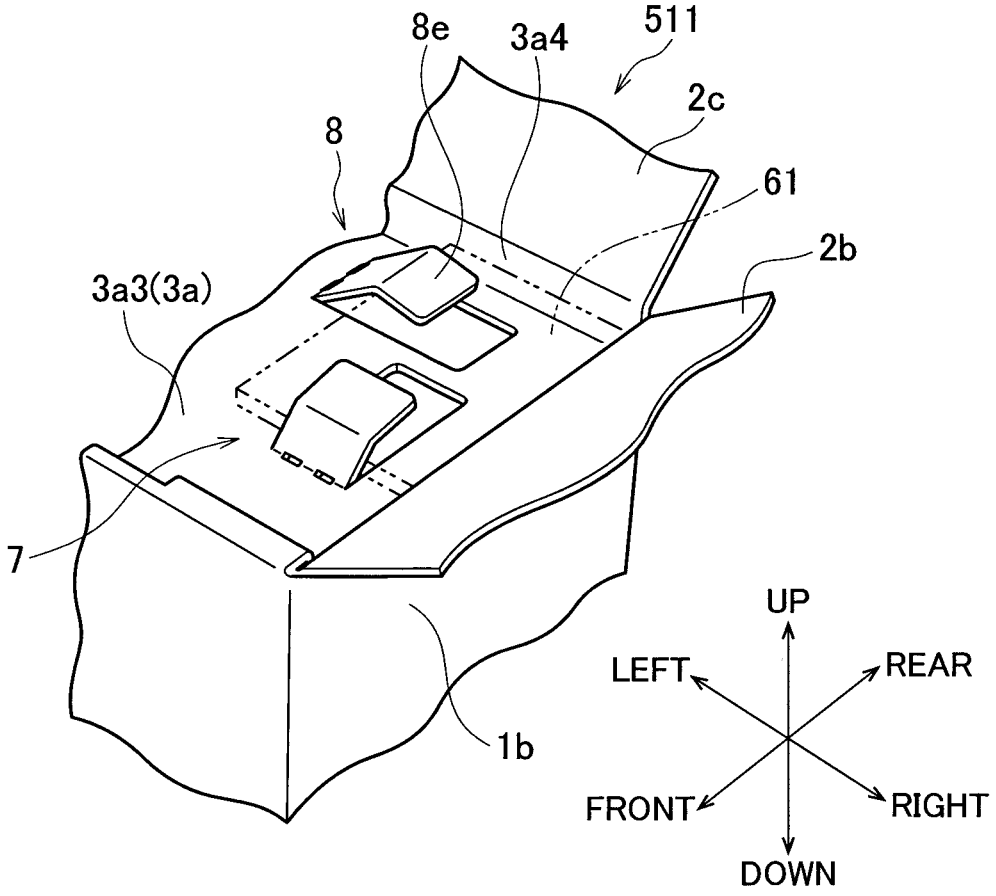
FIG. 14 is a perspective view illustrating another modified example of the box 51.

Moreover, the boxes 51, 51B may be boxes 511, 511B which are modified examples including, in addition to the hold-down piece portions 7, 7B, lateral hold-down piece portions 8, 8B configured to restrict the position of the booklet 61 in the left-right direction with the right face portion 1*b*. FIG. 14 is a partial cross-sectional view illustrating the box 511 as a representative and is a view corresponding to the hold-down piece portion 7 and its periphery in FIG. 1.

As illustrated in FIG. 14, the box 511 includes the lateral hold-down piece portion 8 having a structure similar to the hold-down piece portion 7, at a position corresponding to a left end of the booklet 61 in the shelf portion 3*a*3 of the shelf wall portion 3*a*, in a direction orthogonal to the hold-down piece portion 7. Specifically, a hold-down piece 8*e* of the lateral hold-down piece portion 8 stands with the distal end side thereof tilted toward the right face portion 1*b* to which the rear face portion 1*c* is adjacent and connected. The front and left ends of the booklet 61 are thus held down by the hold-down piece portion 7 and the hold-down piece portion 8, respectively, and the booklet 61 is held between these portions 7, 8 and the abutting portion 3*a*4 and the right face portion 1*b*. The same applies to the box 511B. The box 511B includes a lateral hold-down piece portion 8B in a direction orthogonal to the hold-down piece portion 7B and the front and left ends of the booklet 61 are pressed down. Accordingly, in the boxes 511, 511B, the position of the booklet 61 is restricted in both of the front-rear direction and the left-right direction and the booklet 61 is held more preferably.

What is claimed is:

1. A packaging box comprising:

a shelf portion which partitions an interior of the packaging box into an upper space and a lower space;

an inner flap which is located above the shelf portion as an inner lid and which is bendable to a closed position where the inner flap faces the shelf portion while extending parallel thereto; and a hold-down piece which is disposed at a position facing the inner flap at the closed position in the shelf portion and which has a first bent portion bendable to protrude outward in a middle portion of the hold-down piece, the hold-down piece formed by cutting and raising the shelf portion to be capable of standing in a tilted state where a distal end side thereof extends toward a first side portion, wherein the packaging box is integrally formed of a single material, and wherein, while the inner flap is closed, the hold-down piece is configured to bend from the tilted state to a position where an accessory is fixed by changing a tilt angle of the hold-down piece with respect to the shelf portion to form an oblique angle, which is caused by an external force applied to the hold down piece.

2. The packaging box according to claim 1, wherein the hold-down piece includes a second bent portion bendable to protrude outward, the second bent portion being closer to the distal end than the first bent portion is.

3. The packaging box according to claim 1, further comprising a second hold-down piece which is disposed at a position facing the inner flap at the closed position in the shelf portion and which has a third bent portion bendable to protrude outward in a middle portion of the second hold-down piece, the second hold-down piece formed by cutting and raising the shelf portion and making the second hold-down piece capable of standing in a tilted state where a distal end side thereof extends toward a second side portion adjacent and connected to the first side portion.

4. A packaging method using the packaging box according to claim 1, comprising:

causing the hold-down piece to stand in the tilted state where a distal end portion of the hold-down piece is located above a lower surface of the inner flap at the closed position while bending the first bent portion to make it protrude outward;

placing an object to be packaged on the shelf portion such that the object to be packaged comes into contact or is capable of coming into contact with a tilted portion of the hold-down piece on a base side of the first bent portion, and bringing the inner flap to the closed position and causing the inner flap to bias the hold-down piece downward to cause the packaging box to hold the object to be packaged between the tilted portion and each of the shelf portion and the first side portion.

5. A packaging method using the packaging box according to claim 1, comprising:

causing the hold-down piece to stand in the tilted state where the first bent portion is located above a lower surface of the inner flap at the closed position while bending the first bent portion to make it protrude outward; and inserting an object to be packaged between the shelf portion and a distal end portion of the hold-down piece on the distal end side of the first bent portion and bringing the inner flap to the closed position and causing the inner flap to bias the hold-down piece downward to cause the packaging box to hold the object to be packaged between the shelf portion and the distal end portion.

6. A packaging method using the packaging box according to claim 2, comprising:

causing the hold-down piece to stand in the tilted state where the second bent portion is located above a lower surface of the inner flap at the closed position while bending the first bent portion to make it protrude outward and bending the second bent portion to make it protrude outward such that a supporting piece on the distal end side of the second bent portion comes closer to a base of the hold-down piece while extending to the distal end; and placing an object to be packaged on the shelf portion such that the object to be packaged comes into contact or is capable of coming into contact with a tilted portion of the hold-down piece on a base side of the first bent portion, and bringing the inner flap to the closed position and causing the inner flap to bias the hold-down piece downward to cause the packaging box to hold the object to be packaged between the first side portion and the tilted portion and between the shelf portion and the supporting piece.

7. A packaging method using the packaging box according to claim 2, comprising:

causing the hold-down piece to stand in the tilted state where the first bent portion is located above a lower surface of the inner flap at the closed position while bending the first bent portion to make it protrude outward and bending the second bent portion to make it protrude outward such that a supporting piece on the distal end side of the second bent portion comes closer to a base of the hold-down piece while extending toward the distal end; and placing an object to be packaged between the supporting piece and the shelf portion and bringing the inner flap to the closed position and causing the inner flap to bias the hold-down piece downward to cause the packaging box to hold the object to be packaged between the supporting piece and the shelf portion.

8. A packaging method comprising:

using a packaging box comprising a shelf portion which partitions an interior of the packaging box into an upper space and a lower space, an inner flap which is located above the shelf portion as an inner lid and which is bendable to a closed position where the inner flap faces the shelf portion while extending parallel thereto, and a hold-down piece which is disposed at a position facing the inner flap at the closed position in the shelf portion and which the hold-down piece formed by cutting and raising the shelf portion to be capable of standing in a tilted state where a distal end side thereof extends toward a first side portion, causing the hold-down piece to stand in the tilted state where a distal end portion of the hold-down piece is located above a lower surface of the inner flap at the closed position;

placing an object to be packaged on the shelf portion such that the object to be packaged comes into contact or is capable of coming into contact with a tilted portion on a base side of the hold-down piece, and bringing the inner flap to the closed position and causing the inner flap to bias the hold-down piece in the tilted state downward to cause the packaging box to hold the object to be packaged between the tilted portion and each of the shelf portion and the first side portion by changing a tilt angle of the hold-down piece with respect to the shelf portion to form an oblique angle.

* * * * *